US009017749B2

(12) United States Patent
Ayeni

(10) Patent No.: US 9,017,749 B2
(45) Date of Patent: Apr. 28, 2015

(54) FLAVORED STRAW WITH A FLAVOR DELIVERY SYSTEM

(71) Applicant: Babatope Sewande Ayeni, Athens, OH (US)

(72) Inventor: Babatope Sewande Ayeni, Athens, OH (US)

( * ) Notice: Subject to any disclaimer, the term of this patent is extended or adjusted under 35 U.S.C. 154(b) by 256 days.

(21) Appl. No.: 13/725,771

(22) Filed: Dec. 21, 2012

(65) Prior Publication Data

US 2013/0287902 A1 Oct. 31, 2013

Related U.S. Application Data

(60) Provisional application No. 61/630,890, filed on Dec. 21, 2011.

(51) Int. Cl.
*A47G 21/18* (2006.01)

(52) U.S. Cl.
CPC ..... *A47G 21/183* (2013.01); *A47G 21/189* (2013.01); *A47G 21/18* (2013.01)

(58) Field of Classification Search
CPC .... A47G 21/18; A47G 21/183; A47G 21/189
USPC ..... 426/79, 85, 86, 110, 143, 590, 431, 426/433; 99/316, 317, 323
See application file for complete search history.

(56) References Cited

U.S. PATENT DOCUMENTS

| | | | | |
|---|---|---|---|---|
| 2,128,448 | A * | 8/1938 | Wright | 426/85 |
| 2,867,536 | A | 1/1959 | Mead et al. | |
| 3,326,695 | A * | 6/1967 | Neuhauser | 426/85 |
| 3,463,361 | A | 8/1969 | Cook | |
| 4,091,632 | A * | 5/1978 | Marchewka et al. | 62/1 |
| 4,134,494 | A * | 1/1979 | Wong | 206/216 |
| 4,792,333 | A | 12/1988 | Kidder | |
| 4,921,713 | A | 5/1990 | Fowler | |
| 4,981,468 | A | 1/1991 | Benefiel et al. | |
| 5,047,252 | A * | 9/1991 | Liu et al. | 426/79 |
| 5,094,861 | A | 3/1992 | D'Auguste et al. | |
| 5,440,976 | A * | 8/1995 | Giuliano et al. | 99/485 |
| 5,718,681 | A | 2/1998 | Manning | |
| 5,910,321 | A | 6/1999 | Wong et al. | |
| 5,921,955 | A | 7/1999 | Mazer | |

(Continued)

FOREIGN PATENT DOCUMENTS

EP 0988850 B1 9/2004

OTHER PUBLICATIONS

U.S. Appl. No. 29/324,089, filed Sep. 27, 2009, Peter Baron.

(Continued)

*Primary Examiner* — Nina Bhat

(57) ABSTRACT

A beverage flavoring apparatus comprising of an elongated tubular body, having at least three elongated hollow sections and a container for holding liquid flavor. The top hollow section is for suction and at least one of the hollow sections is adapted to receive liquid flavor and it has a smaller cross sectional area and shorter length which enables the flavoring liquid to be introduced into the beverage stream in minute quantity. The other hollow section is adapted to receive beverage. The container is mounted or loaded on the elongated tubular body so that the section adapted to receive liquid flavor is immersed in the liquid flavor while the other hollow section is dipped in a beverage. As oral suction is being applied, both the liquid flavor and the beverage are drawn up the tubular body and mixes at the hollow suction end before ingestion.

19 Claims, 12 Drawing Sheets

(56) References Cited

U.S. PATENT DOCUMENTS

| | | | | |
|---|---|---|---|---|
| 6,482,451 | B1 * | 11/2002 | Baron | 426/85 |
| 6,503,222 | B2 | 1/2003 | Lo | |
| 6,565,899 | B1 * | 5/2003 | Cecere | 426/85 |
| 6,638,549 | B1 * | 10/2003 | Lloyd | 426/115 |
| 6,749,090 | B2 | 6/2004 | Bailey | |
| 6,966,252 | B2 | 11/2005 | Hamiel et al. | |
| 7,658,303 | B2 | 2/2010 | Woolfson | |
| 8,231,067 | B1 * | 7/2012 | Robinson | 239/33 |
| 8,334,003 | B2 * | 12/2012 | Baron | 426/85 |
| 8,495,951 | B2 * | 7/2013 | Saha | 99/323 |
| 8,584,966 | B2 * | 11/2013 | Roche et al. | 239/33 |
| 2003/0203075 | A1 * | 10/2003 | Taylor | 426/85 |
| 2003/0232111 | A1 * | 12/2003 | Sanso | 426/82 |
| 2004/0046042 | A1 | 3/2004 | Judd | |
| 2005/0142252 | A1 * | 6/2005 | Brown et al. | 426/85 |
| 2006/0193951 | A1 * | 8/2006 | Chen et al. | 426/85 |
| 2007/0051741 | A1 * | 3/2007 | Gaonkar et al. | 220/912 |
| 2008/0075809 | A1 * | 3/2008 | Anderson | 426/85 |
| 2008/0308584 | A1 * | 12/2008 | Blondeel | 222/541.9 |
| 2012/0301579 | A1 | 11/2012 | Lee et al. | |
| 2012/0328741 | A1 * | 12/2012 | Hannah et al. | 426/85 |

OTHER PUBLICATIONS

U.S. Appl. No. 29/193,270, filed Nov. 30, 2004, Michael J. White.
U.S. Appl. No. 09/573,979, filed May 19, 2000, Al Louis Cecere.
Joseph W. Dunn,"Chocolate Straw Finds Big Market; Sales Up Sharply for Product That Gives Flavor to Milk Sucked Through It", New York Times, Aug. 19, 1956, Business & Finance.
U.S. Appl. No. 12/321,879, filed Mar. 6, 2012, Goldscheln.

* cited by examiner

FLAVORED STRAW WITH A FLAVOR DELIVERY SYSTEM

CROSS-REFERENCE TO RELATED APPLICATIONS

This application claims the benefit of provisional patent application Ser. No. 61/630,890, Filed 2011 Dec. 21 by the present inventor.

FIELD OF THE INVENTION

This invention relates to flavored drinking straw. More particularly, it relates to the regular drinking straw that contains different kinds of flavor (strawberry, vanilla, chocolate and many more) inside of it. The flavor is usually held in the straw, the passage of beverage or water and also allows the flavor to dissolve and flavor the beverage when the beverage is sipped through the straw.

BACKGROUND

1. Prior Art

The following is a tabulation of some prior art that presently appears relevant:

| Pat. No. | Issue Date | Patentee |
|---|---|---|
| 5,094,861 | 1992 Mar. 10 | Susanne D'Auguste et al |
| 6,482,451 | 2002 Nov. 19 | Peter Baron |
| 3,463,361 | 1969 Aug. 26 | Donald L. Cook et al |

2. Description of the Prior Art

Various flavoring devices have been developed and patented. These devices add flavors and enhance the consumption of beverages. These devices utilized various manners of securing flavoring material within its structure.

Examples of such devices may be found in U.S. Pat. No. 5,094,861 to D'Auguste et al wherein the drinking straw is an arrangement including a drinking tube containing a powdered flavoring laminated to an interior surface of the drinking tube for dissolving upon contact with a fluid directed through the tube, with end caps removably mounted relative to the tube for preserving freshness of the flavoring there within.

U.S. Pat. No. 6,482,451 to Baron wherein a flavoring receptacle contains a predetermined portion of flavoring agent for sale and use in conjunction with a compatible prepackaged unflavored beverage of appropriate relative volume. The flavoring receptacle is generally elongate and tubular in shape and contains end caps. The flavoring receptacle is thereby adapted for use as a straw. Passage of the unflavored beverage through the flavoring receptacle provides for mixing with the flavoring agent to produce a flavored beverage.

U.S. Pat. No. 3,463,361 to Cook et al wherein the invention is a flavoring device comprising a conduit having an inlet and an outlet. Attached to the conduit intermediate the inlet and outlet is a chamber for receiving flavoring material. Means of communicating between the flavoring chamber and conduit are provided whereby liquid drawn into the inlet and through the conduit is contacted with the flavoring material through the aperture in the wall of the conduit prior to exit from the conduit at the outlet.

Many of these devices utilize flavor imparting materials that are in powder form or dry state. When these devices are used in flavoring beverages, the flavoring is not uniform and therefore the taste of the flavored beverage is not uniform because the powder or dry flavoring material takes some time to dissolve upon contact with beverage or fluid.

These flavored straws that exists in the market, have flavors that are in powder form. Sometimes they are clustered to form small beads or granules. The problem associated with this is when the flavor gets in contact with the beverage or water, most of the dissolved powder flavor drains back into the beverage or water because the porous partitioning holding the powder flavor in position inside the straw also allows the downward passage of dissolved powder flavor into the beverage or water thereby mixing up with the drink especially when the straw is left in the beverage or water for a short period of time this defeats the purpose of having the powder flavor in the straw Secondly, if you drink too fast it makes the beverage or water to have limited saturation period with the flavor and leaves you with a straw full of flavor beads or powder that didn't dissolve and you end up having little or no flavor in the beverage or water you sip in. If you slurp too slowly, the flavor is too strong but you end up with half a glass of unflavored beverage or water to drink, in addition to that, one has to wait a few seconds to allow the powder flavor in the straw to dissolve in order to achieve a better flavored beverage. Moreover, these existing prior arts are usually used when drinking milk and they are not efficient enough due to design and the nature of the flavor they carry. If used to drink water, the flavor drains out at the other end of the straw faster because water increases the solubility of the flavor while milk dissolves the flavor at a slower pace. Another limitation of the existing flavored straw is that its design inadvertently put a limit on what kind of flavors it can carry thereby placing a limit on the usage. In these respects, the Flavored straw with a flavor delivery system according to the present invention substantially departs from the conventional concepts and designs of the prior art, and in so doing provide an apparatus primarily developed for the purpose of providing an enhanced drinking experience.

SUMMARY OF THE INVENTION

The beverage flavoring apparatus comprises of an elongated tubular body with at least three elongated hollow sections and a container holding a liquid flavor imparting material. At least of the elongated hollow section is shorter and it is adapted to receive liquid flavoring material. The other elongated hollow section is adapted to receive beverage and the other elongated hollow section is a suction end.

This flavoring material is liquid and it can be any kind of flavor. Examples is vanilla, strawberry, chocolate, orange, banana, vitamins, probiotics, pharmaceuticals and also alcohol. The sweetener used in this liquid flavors could be natural or artificial sweeteners for example sucalose, sugar, acesulfame, aspartames and many more. To use the apparatus to flavor beverage, the container holding the liquid flavoring has to be loaded on the tube and positioned in such a way that the smaller elongated hollow section is immersed in the liquid flavoring present in the container that is loaded on the tube and the other elongated hollow section adapted to receive beverage is immersed in a beverage. As the liquid is being drawn through the suction end of the tube thereby both streams of the liquid flavoring material and the liquid beverage travel up toward the suction end through their respective elongated hollow sections and both streams mixes together forming a single stream of flavored beverage before being ingested by the user. The elongated hollow section adapted to receive liquid flavor has a smaller dimension so as to enable the flavoring liquid to be introduced by suction into the beverage stream in minute quantity.

DETAIL DESCRIPTION OF THE FIRST EMBODIMENT

Figure 1:
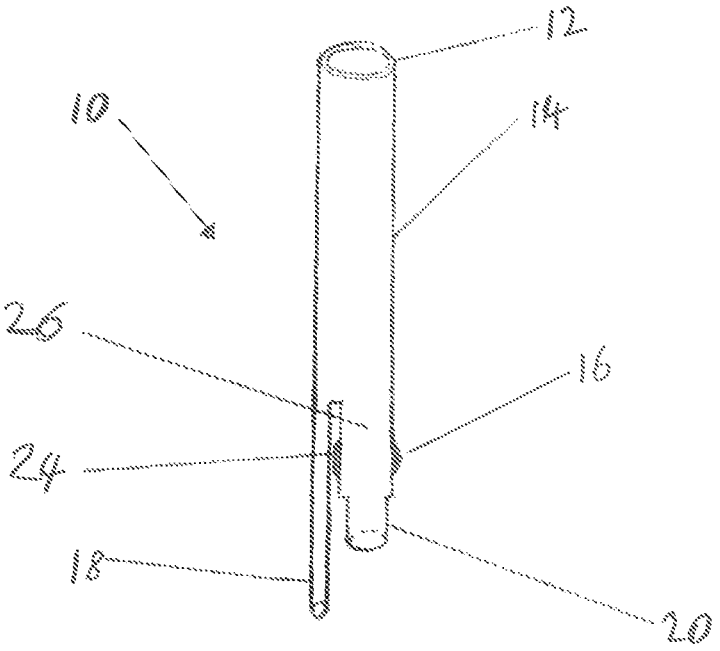
FIG. 1 is a perspective view of the elongated tubular body showing three hollow sections with hooks on the first part of the hollow section which is adapted for beverage intake.
Figure 2:
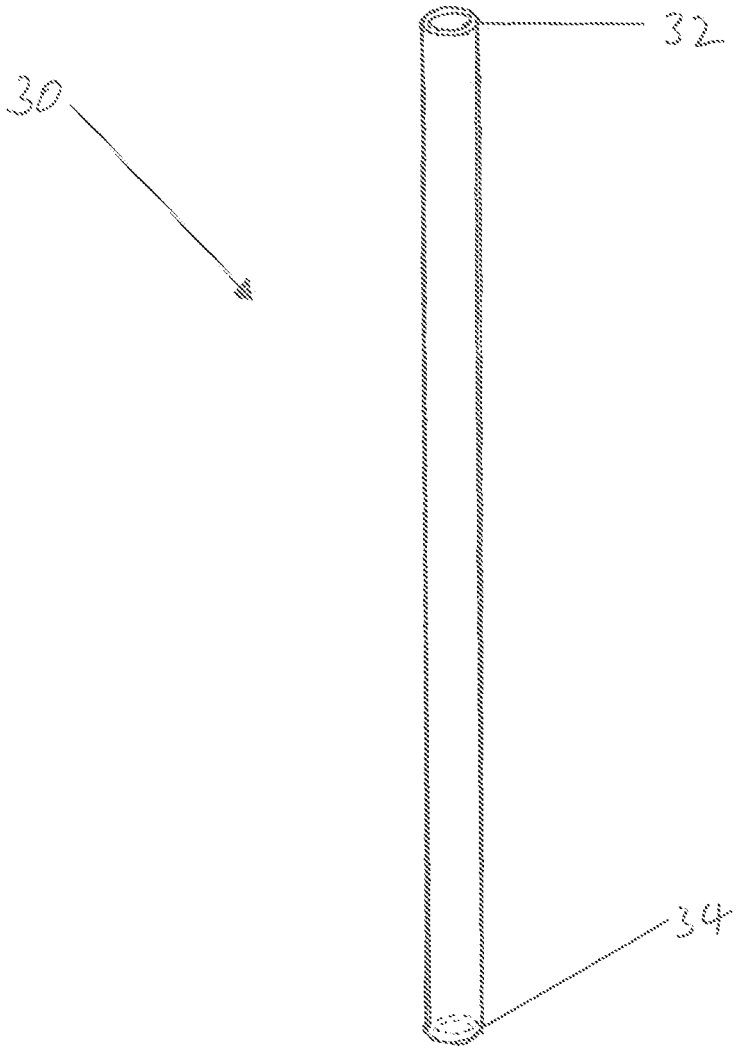
FIG. 2 is a perspective view showing the second part of the hollow section which is adapted for beverage intake.
Figure 3:
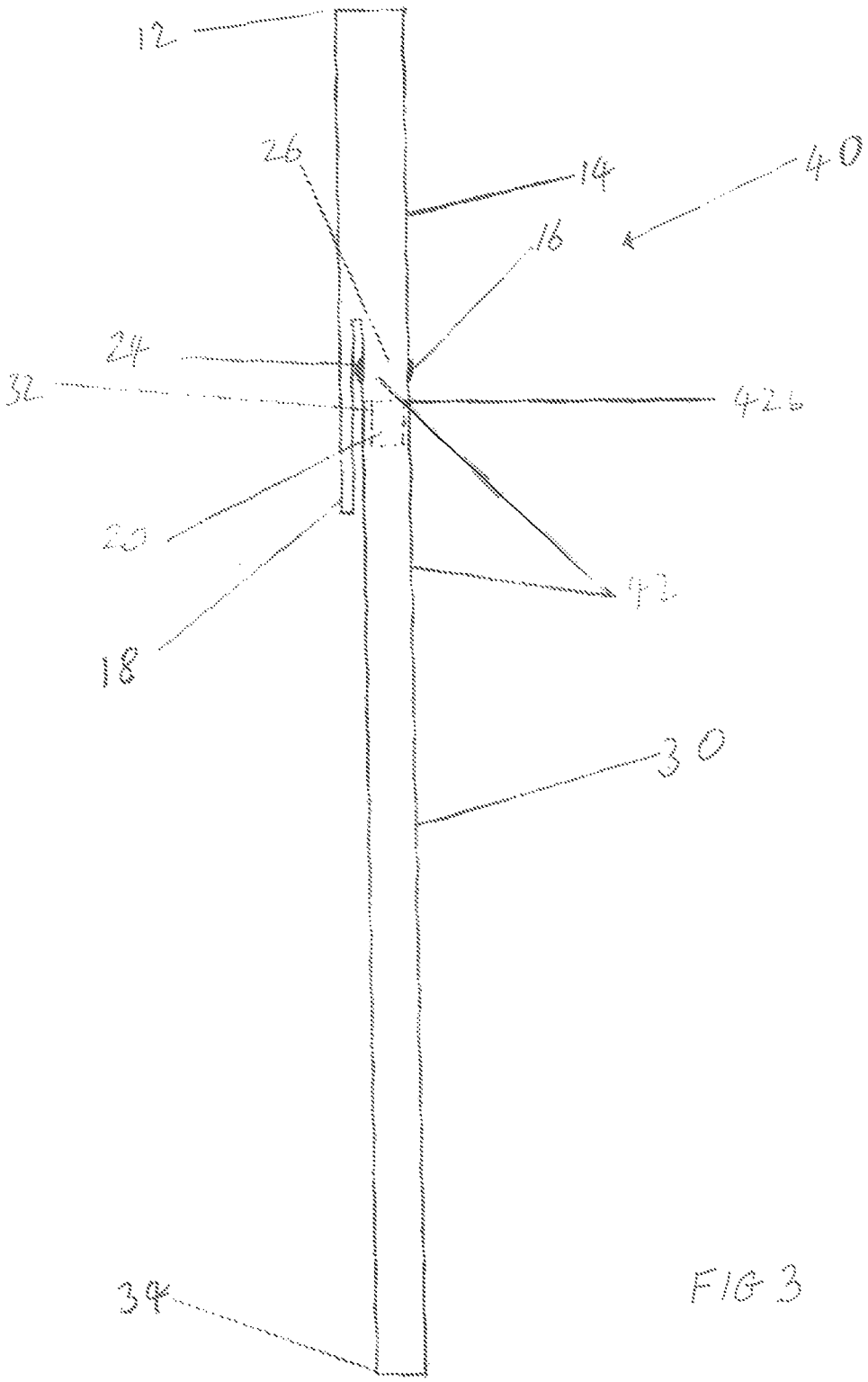
FIG. 3 is a plan view of the elongated tubular body.
Figure 4:
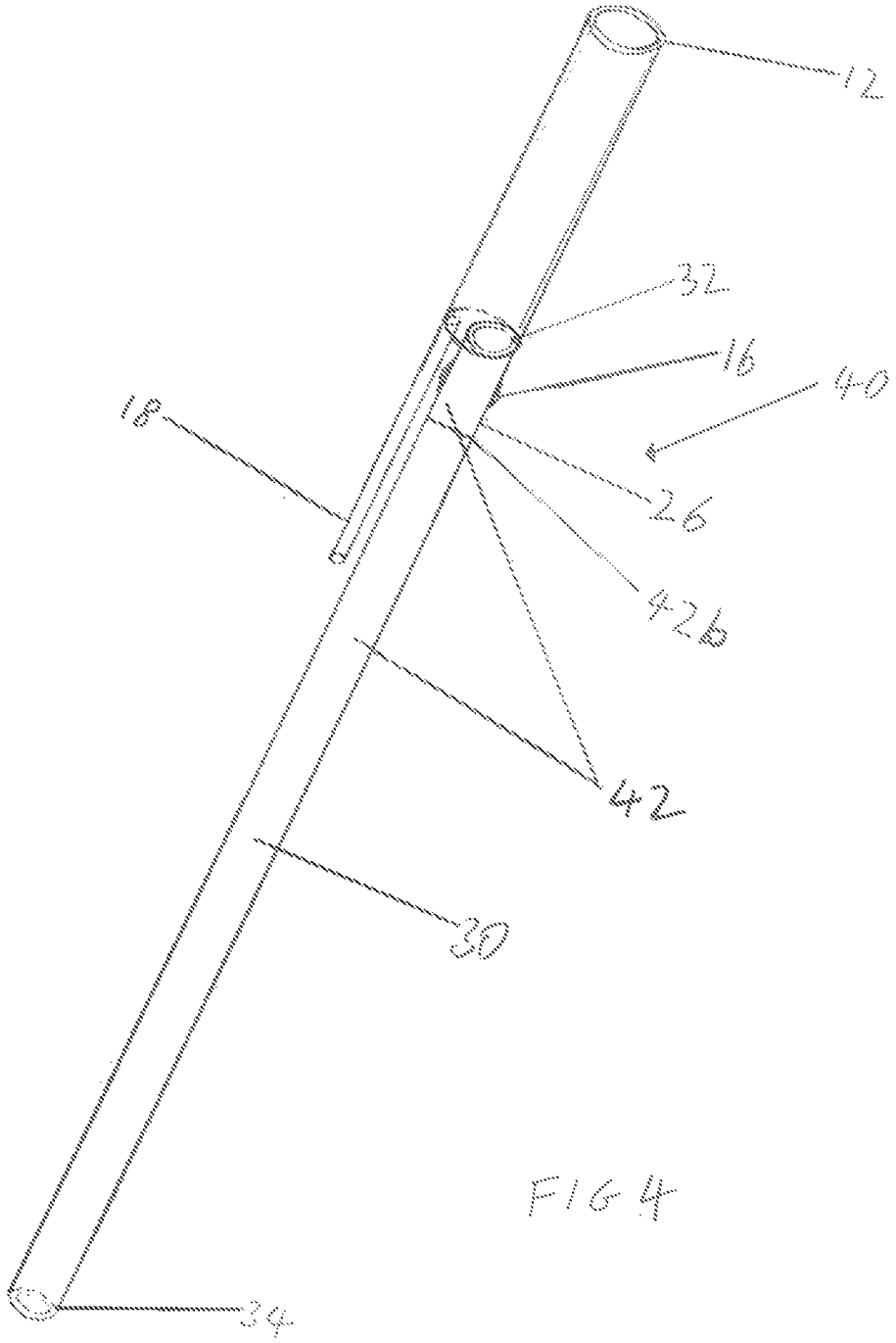
FIG. 4 is a side view of the elongated tubular body.
Figure 5:
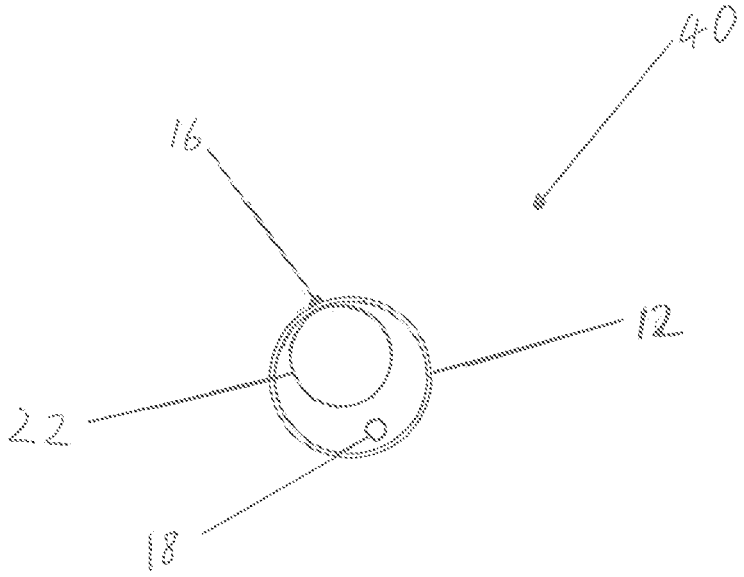
FIG. 5 is another perspective view showing the drinking tube in greater detail.
Figure 10:
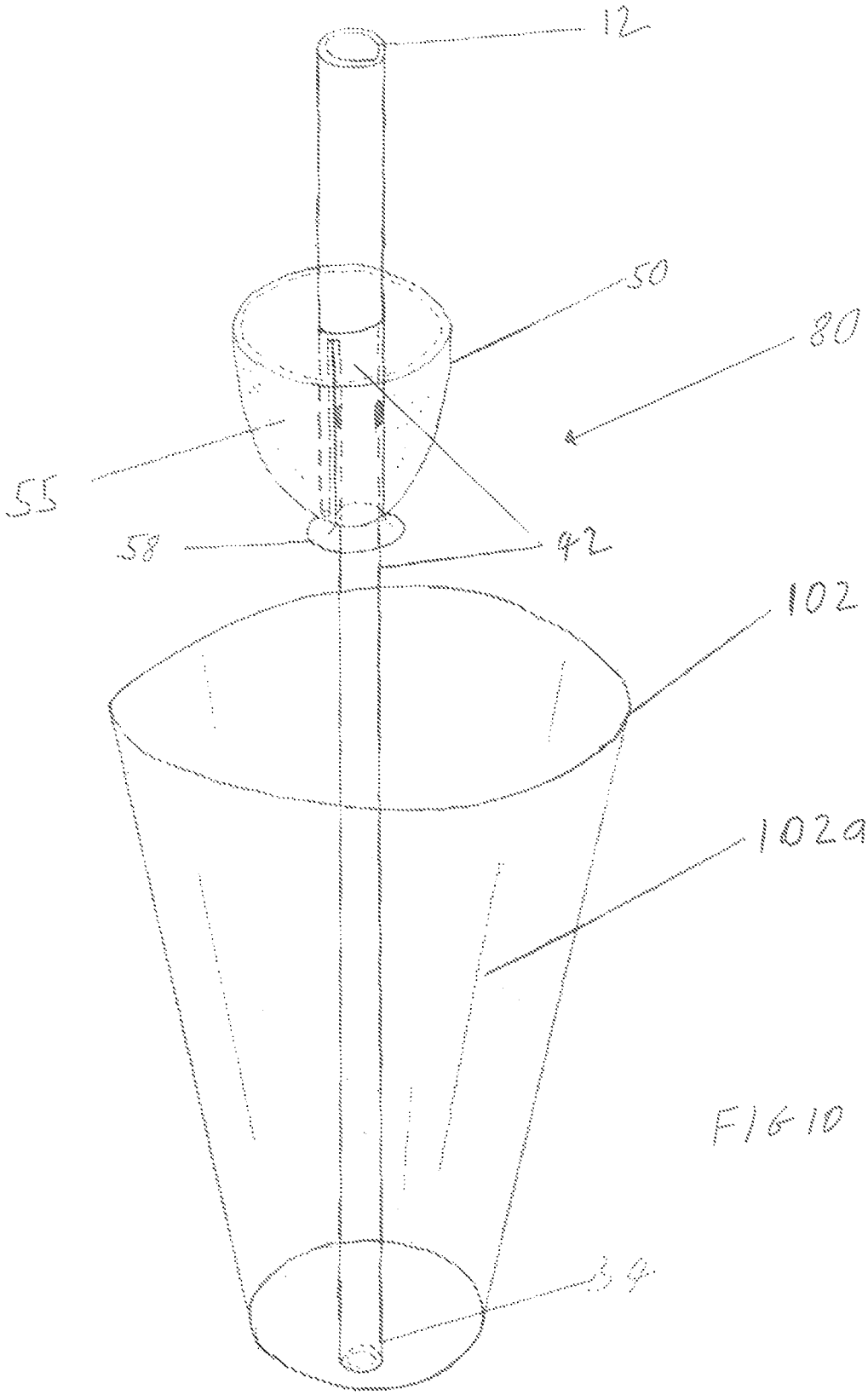
FIG. 10 shows the invention in use in a cup of beverage and it helps portray its functionalities.

One embodiment of the beverage flavoring apparatus is illustrated in FIG. 10. The elongated tubular body 40 (FIG. 4) is prefabricated and it has three elongated hollow sections. For manufacturability, the third hollow section 42 (FIG. 4) is in two parts 26 and 30 respectively. Part 26 is fitted together with tube 30 by fitting opening 20 (FIG. 1) into opening 32 (FIG. 2) to form the hollow tube section 42 which is adapted to receive beverage.

Figure 6:
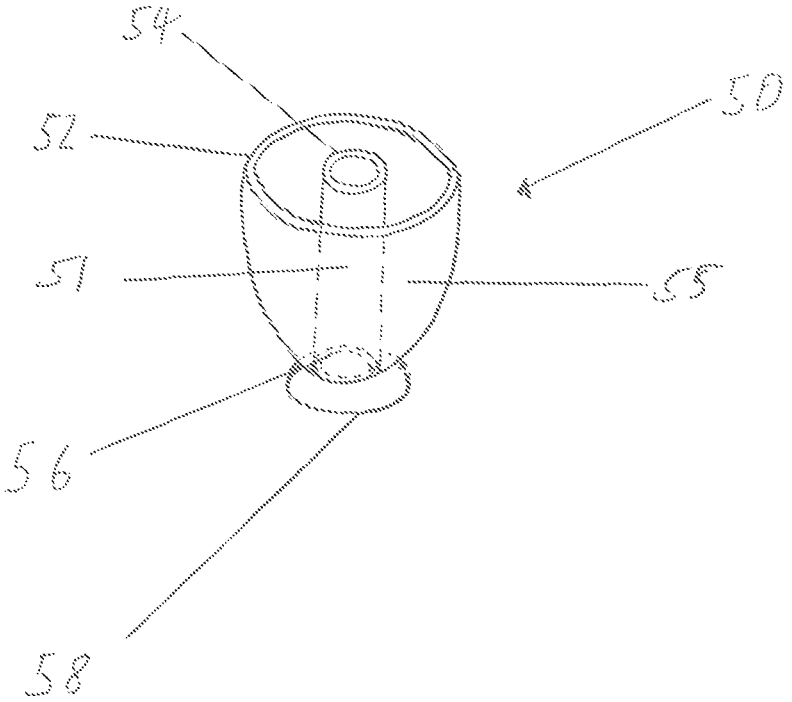
FIG. 6 is a perspective view of the container adapted for holding liquid flavoring material showing the hollow center with open ends and a holder at the base of the container.
Figure 7:
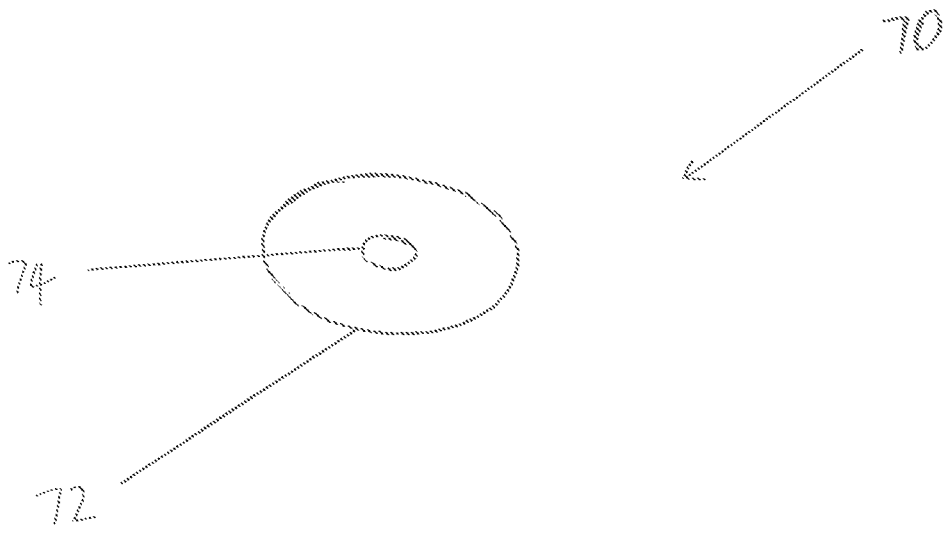
FIG. 7 is a perspective view of the pierceable thin sheet of material.

A container 50 (FIG. 6) is designed to hold liquid flavor 55 and to be mounted or loaded on elongated tubular body 40. The container 50 has an opening 52 through which the liquid flavor 55 is poured into the container 50. To keep the liquid flavor intact, the container 50 is sealed with a pierceable thin sheet of material 70 which has a center 74 (FIG. 7). This thin sheet of material could be aluminum foil, plastic film or any pierceable thin sheet of material. The thin sheet of material 70 is placed on container 50 in such a way that edge 72 of the thin sheet 70 is placed on opening 52 thereby making center 74 to register with open end 54 of the container 50 and then sealed by induction to keep the liquid flavor intact in the container 50.

Figure 8:
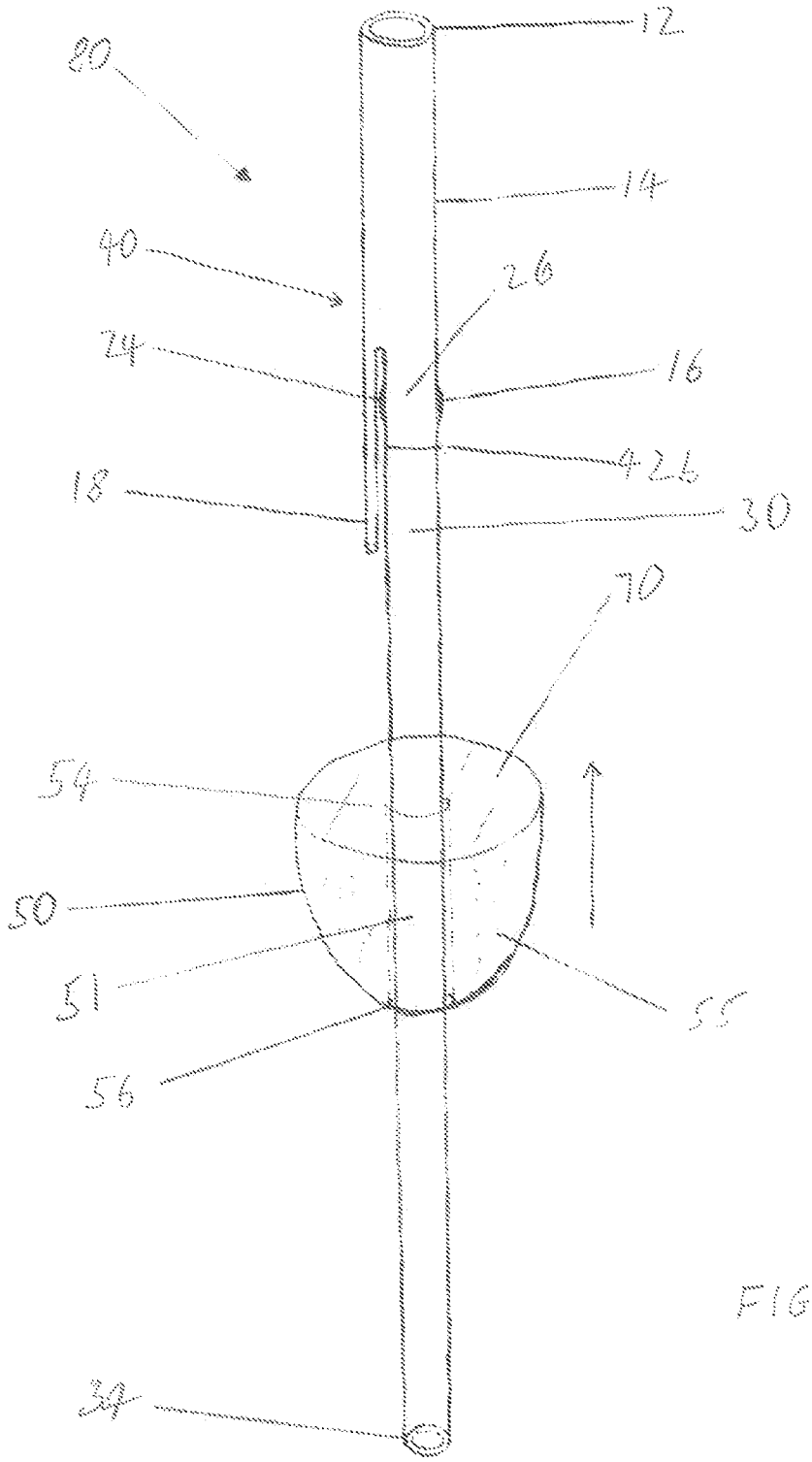
FIG. 8 is a perspective view showing the flavor holding container being loaded on the elongated tubular body.
Figure 9:
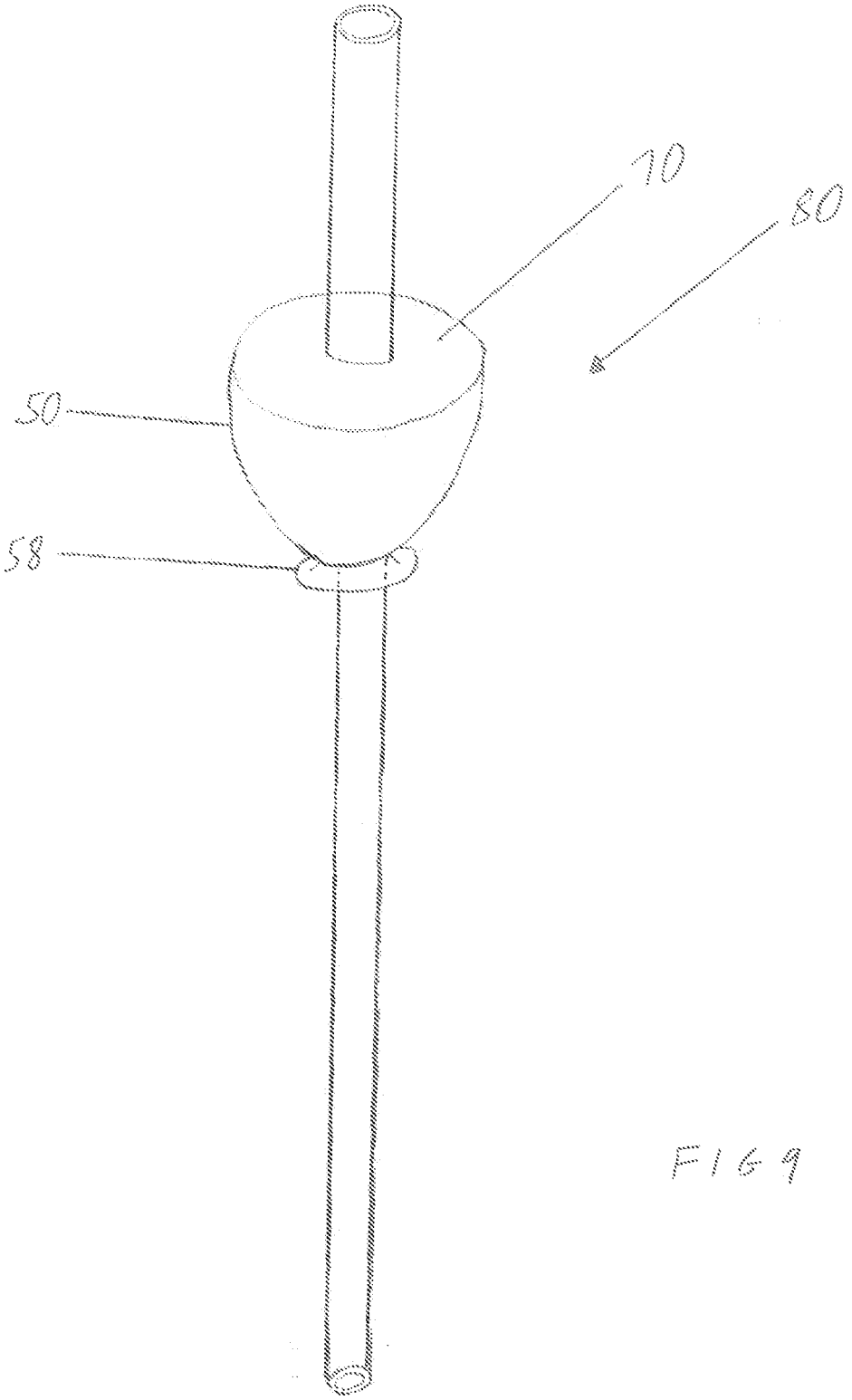
FIG. 9 shows the complete assembly of the flavor delivery system

As shown in FIG. 8, the combination of the drinking tube 40 and the sealed container 50 makes up the flavor delivery system or the beverage flavoring apparatus 80. The container is loaded on the drinking tube 40 at end 34 through the open end 54 and open end 56 of the hollow center 51. The sealed container is moved up the drinking tube until the smaller elongated hollow section 18 pierces through thin sheet of material 70 to be immersed in the liquid flavor 55. The smaller elongated hollow section 18 also has a smaller diameter than the rest of the elongated hollow sections, this is to enable the flavoring liquid to be introduced by suction into the beverage stream in minute quantity. After the thin sheet is pierced, the container is further moved up in order to be in contact with the hook 16 and hook 24 and to be held securely by the hooks. These hooks keeps the container 50 loaded or mounted on the drinking tube so that the liquid flavoring 55 in the container 50 will maintain its contact with the shorter elongated hollow section 18.

Figure 11:
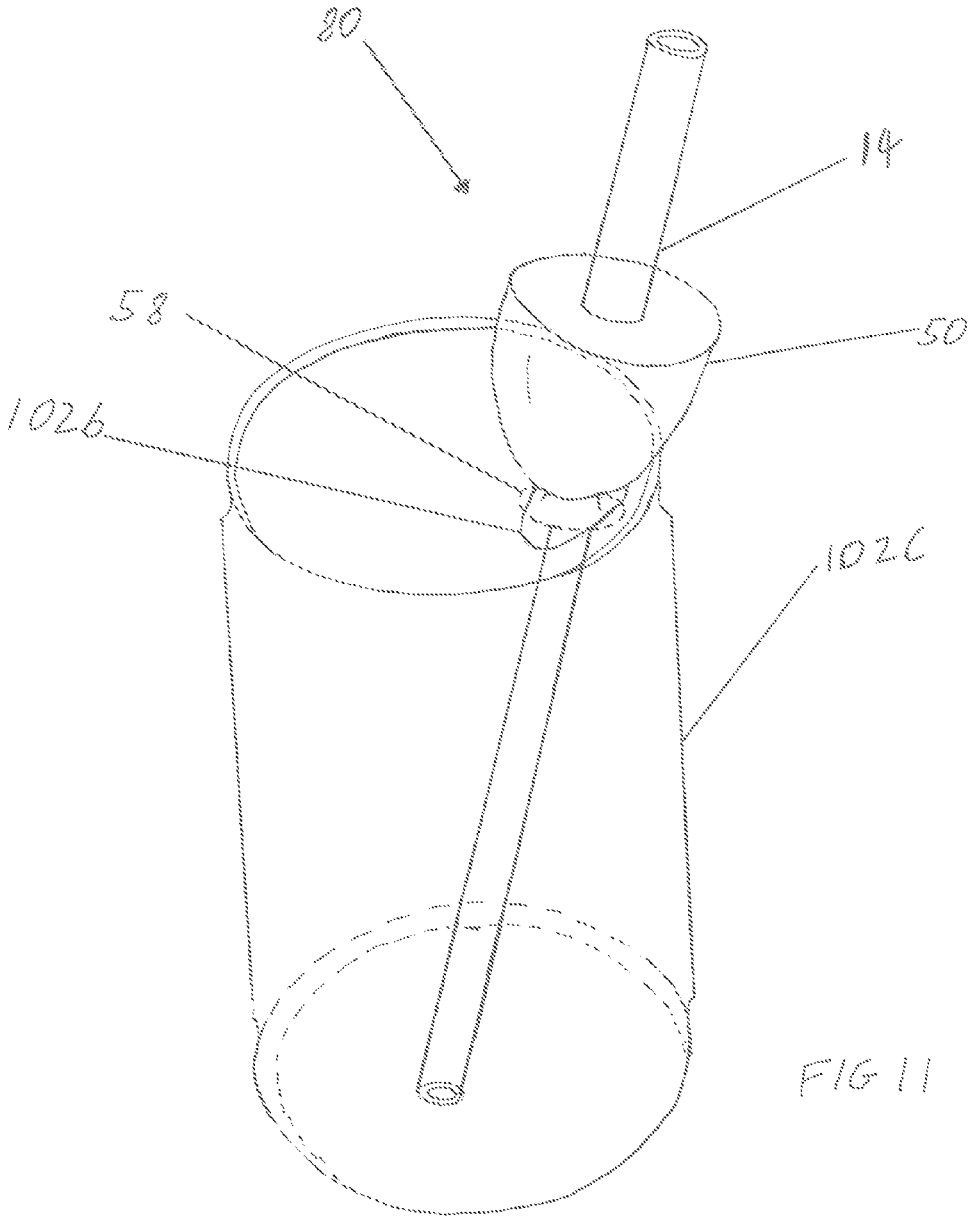
FIG. 11 shows the invention being securely held to the opening of a beverage can with the help of the base holder

As seen in FIG. 10 the elongated hollow section end 34 of beverage flavoring apparatus 80 is placed in a cup of beverage 102. Suction force is applied by the mouth of the user at suction end 12 of beverage flavoring apparatus 80. The stream of flavoring liquid 55 travels through elongated hollow section 18 and stream of beverage 102*a* travels through elongated hollow section 42 in the same direction toward the suction end 12 and both streams mixes together at the elongated hollow section 14 thereby forming a single stream of flavored beverage before being ingested by the user. If the beverage to be flavored is in a beverage can or pop can, the holder 58 at the base of container 50 is designed to securely hold the beverage flavoring apparatus 80 in the can 102*c* (FIG. 11) at the opening 102*b* by placing the holder 58 in opening 102*b* and then twisting beverage flavoring apparatus 80 in order for base holder 58 to get a good grip with the opening 102*b* on beverage can 102*c*

Figure 12:
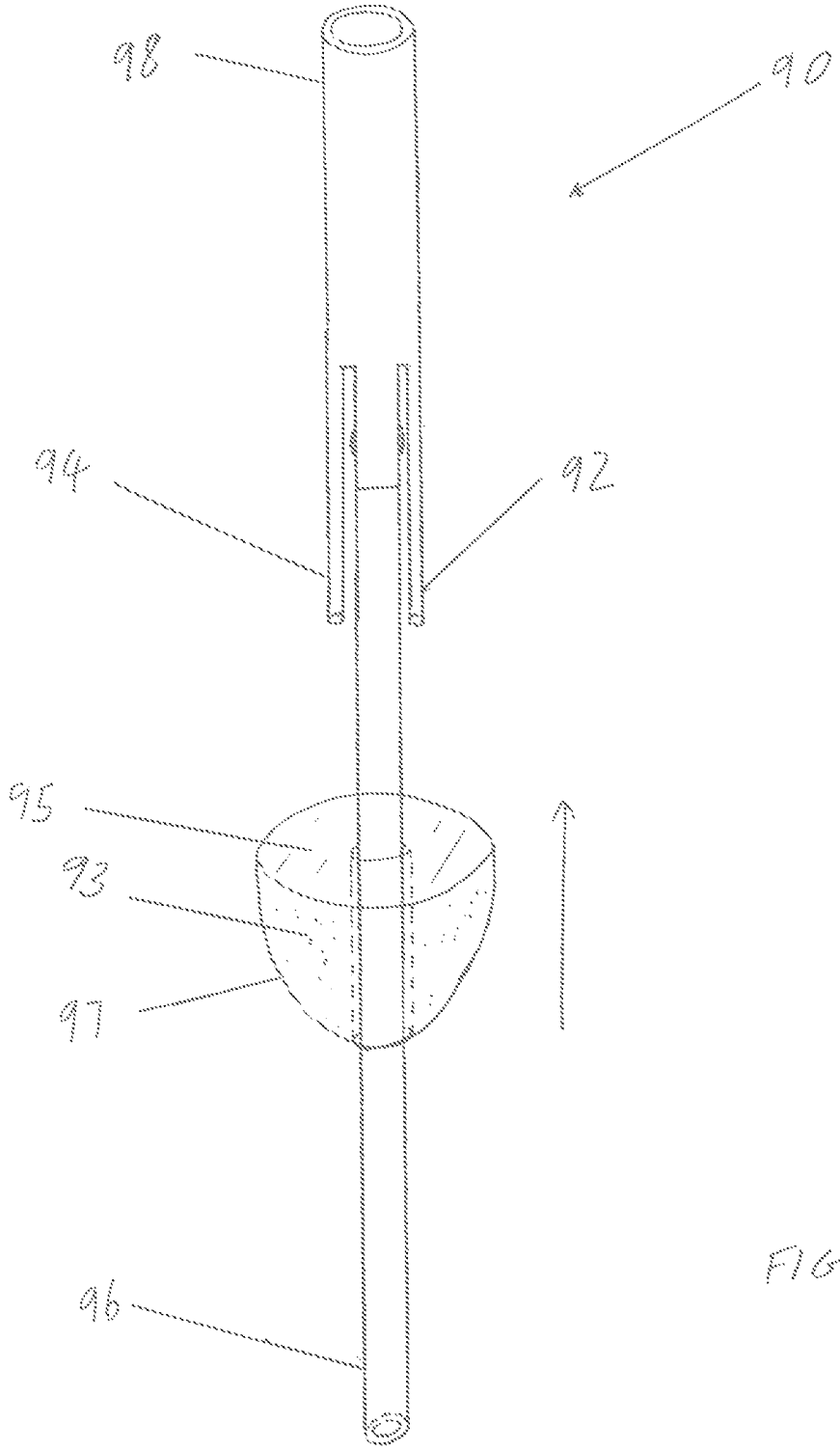
FIG. 12 illustrates the drinking tube having an additional elongated hollow section.

FIG. 12—Alternative Embodiments

There are various possibilities with regard to the relative the numbers of elongated hollow sections the drinking tube can have. FIG. 12 shows a drinking tube 90 having four elongated hollow sections of which two of the elongated hollow sections 94 and 92 respectively are adapted to pierce the thin sheet of material 95 to be immersed and receive liquid flavor 93 present in container 97

As to a further discussion of the manner of usage and operation of the present invention, the same should be apparent from the above description. With respect to the above description then, it is to be realized that the optimum dimensional relationships for the parts of the invention, to include variations in size, materials, shape, form, function and manner of operation, assembly and use, are deemed to be within the expertise of those skilled in the art, and all equivalent structural variations and relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention and the scope should be determined not by the embodiments illustrated, but by the appended claims and their legal equivalents.

What is claimed is:

1. A beverage flavoring apparatus comprising:

a). at least one container adapted for holding a liquid flavoring material, said container having a predetermined cross-sectional shape;

b.) a prefabricated elongated tubular body having predetermined dimensions having at least three elongated hollow sections each having an open end and one of said hollow sections being a suction end adapted for application of suction force by the mouth of the user and the other end of the elongate hollow section to be disposed into a liquid; said elongated hollow liquid section further branching into two elongated branched sections; one of said branched section constructed and arranged for receiving a liquid beverage and the other of said branched hollow sections having a smaller cross-sectional area and a shorter length than the elongated suction hollow tubular body, said elongated branched section constructed to receive a minute quantity of liquid flavoring from said container;

c.) said container being in operative connection with said elongate tubular body wherein said hollow branched section when in contact with the liquid favoring is in fluid connection with the elongated tubular body such that when the elongated tubular body is immersed in a beverage, the flavoring mixes with the liquid beverage when a suction force is applied by the mouth of the user at the suction end which permits the flavoring from the container and the liquid beverage to travel through the hollow elongated tube forming a single stream of flavored beverage before ingestion by the user.

2. The beverage flavoring apparatus of claim 1 wherein said container has a hollow center with open ends so that said container can be loaded on said elongated tubular body through said open ends.

3. The beverage flavoring apparatus of claim 1 wherein said container has an opening whereby the said container is filled with said liquid flavor.

4. The beverage flavoring apparatus of claim 3 wherein said opening of said container is sealed with a pierceable thin sheet of material.

5. The beverage flavoring apparatus of claim 1 wherein said elongated tubular body is a prefabricated drinking tube with predetermined dimensions, having at least three elongated hollow sections each having an open end.

6. The beverage flavoring apparatus of claim 1 wherein said elongated hollow section with said smaller cross sectional area and a shorter length is adapted to pierce said pierceable thin sheet of material so that it can be immersed in said liquid flavor and to receive said liquid flavor present in the said container.

7. The beverage flavoring apparatus of claim 1 wherein said means for connecting said container on said hollow drinking tube comprises of hooks on the wall of said hollow drinking device and said hollow center with open ends present in said container.

8. The beverage flavoring apparatus of claim 1 wherein said container has a holder at its base for securely attaching said beverage flavoring apparatus to the opening of a beverage can.

9. The beverage flavoring apparatus of claim 8 wherein said container has a hollow center with a pair open ends so that said container can be loaded on said elongated tubular body through said open ends.

10. The beverage flavoring apparatus of claim 8 wherein said container has an opening whereby the said container is filled with liquid flavor.

11. The beverage flavoring apparatus of claim 9 wherein said opening of said container is sealed with a pierceable thin sheet of material.

12. The beverage flavoring apparatus of claim 8 wherein said elongated tubular body is a prefabricated drinking tube with predetermined dimensions, having at least three elongated hollow sections each having an open end.

13. The beverage flavoring apparatus of claim 8 wherein said elongated hollow section with said smaller cross sectional area and a said shorter length is adapted to pierce said pierceable thin sheet of material so that it can be immersed in said liquid flavor and to receive said liquid flavor present in the said container.

14. The beverage flavoring apparatus of claim 8 wherein said means for loading said container on said hollow drinking device comprises of hooks on the wall of said hollow drinking device and said hollow center with open ends present in said container.

15. The beverage flavoring apparatus of claim 8 wherein said container has a holder at its base for securely attaching said beverage flavoring apparatus to the opening of a beverage can.

16. A method for using a beverage flavoring apparatus, comprising:

a) providing at least a container adapted for holding a liquid flavoring, said container has a predetermined cross-sectional shape, b) providing a prefabricated elongated tubular body with predetermined dimensions, having at least three elongated hollow sections each having an open end and one of said elongated hollow sections is a suction end adapted for the application of suction force by the mouth of the user and said elongated hollow section adapted for application of suction force branches out into at least two other elongated hollow sections which are liquid ends, one adapted to receive in liquid beverage and the other has a smaller cross sectional area and a shorter length than the rest of said elongated hollow sections and it is adapted to receive said liquid flavoring material in present in said container and c) loading said container on said elongated tubular body in a manner that said elongated hollow section with said smaller cross sectional area and shorter length is immersed in the liquid flavor imparting material present in said container through an opening on said container, d) immersing said hollow end adapted for immersion in a liquid beverage into a beverage cup holding a liquid beverage and using a holder present at the base of the said container as a mean of holding said beverage flavoring apparatus to the opening of said beverage cup, e) applying suction force by the mouth of the user at said elongated hollow section adapted for suction thereby sucking in two separate streams of liquids and both said streams are of said liquid flavor and said liquid beverage and they both travel up in the direction of said suction end through theft respective said elongated hollow sections whereby said streams meets at said elongated hollow section adapted for suction and mixes into a single stream of flavored beverage mixture before being ingested by the user.

17. The method of claim 16 wherein said container has a hollow center with a pair open ends so that said container can be loaded on said hollow drinking device through said open ends.

18. The method of claim 16 wherein said opening of said container is sealed with a pierceable thin sheet of material.

19. The method of claim 16 wherein said elongated hollow section with said smaller cross sectional area and a said shorter length is adapted to pierce said pierceable thin sheet of material so that it can be immersed in said liquid flavor and receive said liquid flavor present hi the said container.

* * * * *